US006769680B2

(12) United States Patent
Kojima et al.

(10) Patent No.: US 6,769,680 B2
(45) Date of Patent: Aug. 3, 2004

(54) SHEET FEEDING APPARATUS AND IMAGE FORMING APPARATUS EQUIPPED THEREWITH

(75) Inventors: Ryuichi Kojima, Toride (JP); Ryukichi Inoue, Abiko (JP); Masayuki Fukuda, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/854,574

(22) Filed: May 15, 2001

(65) Prior Publication Data

US 2002/0005611 A1 Jan. 17, 2002

(30) Foreign Application Priority Data

May 24, 2000 (JP) ..... 2000-153726

(51) Int. Cl.[7] ..... B65H 3/06
(52) U.S. Cl. ..... 271/117
(58) Field of Search ..... 271/117

(56) References Cited

U.S. PATENT DOCUMENTS 3,150,871 A * 9/1964 Boblit et al. ..... 271/117
3,306,491 A * 2/1967 Esiner et al. ..... 271/117
3,949,979 A * 4/1976 Taylor et al. ..... 271/10.01
4,319,740 A * 3/1982 Ulseth ..... 271/118
4,561,644 A * 12/1985 Clausing ..... 271/110
5,253,854 A 10/1993 Tanoue et al.
5,292,116 A 3/1994 Inoue et al.
5,358,230 A 10/1994 Ikemori et al.
5,485,991 A * 1/1996 Hirano et al. ..... 271/109
5,927,702 A 7/1999 Ishii et al.
6,055,407 A 4/2000 Inoue et al.
6,070,867 A 6/2000 Tsurumi et al.
6,116,589 A * 9/2000 Bortolotti ..... 271/117
6,299,156 B1 * 10/2001 Kaneda et al. ..... 271/117
6,375,183 B1 * 4/2002 Inoue et al. ..... 271/10.11

FOREIGN PATENT DOCUMENTS

JP 55052832 A * 4/1980 ..... B65H/1/04
JP 62175367 A * 8/1987 ..... B65H/3/44
JP 5 278880 A * 10/1993

* cited by examiner

*Primary Examiner*—Donald P. Walsh
*Assistant Examiner*—Joseph Rodriguez
(74) *Attorney, Agent, or Firm*—Fitzpatrick, Cella, Harper & Scinto

(57) ABSTRACT

An object of the present invention is to provide a sheet feeding apparatus that has sheet supporting device for supporting a sheet, a driving rotary member driven and rotated by a driving source, a rocking member disposed rockably on the driving rotary member, a sheet feeding rotary member rotatably disposed on the rocking member and can be brought into contact with the sheet supported by the sheet supporting device, a following rotary member coupled with the sheet feeding rotary member on the rocking member, a winding and hanging member hung around the driving rotary member and the following rotary member, a separating slant surface disposed on a side of leading ends of sheets fed out by the sheet feeding rotary member for separating the sheets one by one, and rocking force generating device disposed on the rocking member for guiding a tensed side of the winding and hanging member in a direction away from the sheets, and for generating a rocking force, on the rocking member, which brings the sheet feeding rotary member into pressure contact with the sheet by receiving a pressing force produced due to a tension of the tensed side.

11 Claims, 10 Drawing Sheets

SHEET FEEDING APPARATUS AND IMAGE FORMING APPARATUS EQUIPPED THEREWITH

BACKGROUND OF THE INVENTION

1. Field of the Invention

The present invention relates to a sheet feeding apparatus which feeds sheets and an image forming apparatus such as a copier, a facsimile, a printer or a multi function peripheral (MFP) having functions of these apparatuses which is equipped in a main body with the sheet feeding apparatus.

2. Related Background Art

A sheet feeding apparatus is conventionally assembled, for example, in a main body of an image forming apparatus and feeds sheets to image forming means which forms an image. The image forming apparatus forms images on individual sheets. A sheet separating mechanism which separates the sheets one by one is disposed in the sheet feeding apparatus assembled in such an apparatus which carries out any treatment on the individual sheets.

As an example of this sheet separating mechanism, there is a slant surface type sheet separating mechanism which separates sheet by utilizing a slant surface. This slant surface type sheet separating mechanism is configured to stop a leading end of an uppermost sheet fed (sent) by a sheet feeding roller with the slant surface and guide the uppermost sheet along the slant surface. Should a plurality of sheets be sent out following the uppermost sheet sent by the sheet feeding roller, the sheet separating mechanism stops and disposes leading ends of the plurality of sheets with the slant surface, thereby feeding the sheets one by one in a separated condition.

Usable as sheets which can be separated with the sheet separating mechanism are various kinds of articles such as paper, resin sheets, thin paper, thick paper, postal cards, letters and the like.

Referring now to FIG. 9, description will be made of a configuration of a sheet feeding apparatus in which the slant surface type sheet separating mechanism is assembled.

A sheet feeding apparatus 101 is composed of a sheet feeding tray unit 102 in which sheets to be fed are mounted, a sheet feeding unit 103 which is to feed the mounted sheets consecutively, a conveying unit 104 which conveys the fed sheets to an image forming unit 3, for example, of an image forming apparatus 1 shown in FIG. 1 and the like.

The sheet feeding tray unit 102 is composed of a sheet feeding tray 121 on which sheets S are to be mounted, a separating slant surface plate 122 which stops, disposes and separates the sheets at a sheet feeding time while guiding the sheets obliquely, and the like. The separating slant surface plate 122 is the slant surface type sheet separating mechanism.

The sheet feeding unit 103 is composed of a sheet feeding arm 114 which is rotatably attached to a driving shaft 113, a driving gear 112 which is integrated with the driving shaft 113, a sheet feeding roller 105 rotatably disposed at a rocking end of the sheet feeding arm 114, a following gear 123 which is integrated with the sheet feeding roller 105, a gear train 124 which consists of six idler gears 111, 110, 109, 108, 107 and 106 which are provided on the sheet feeding arm 114 to transfer the rotation of the driving gear 112 to the following gear 123, and the like.

The conveying unit 104 is composed of a lower guide 115 which guides a bottom surface of a fed sheet, an upper guide 116 which is integrated with the lower guide 115 and guides a top surface of the fed sheet, a roller holder 119 which is rotatably supported by the upper guide 116, a conveying roller 117 which is disposed on the lower guide 115 and conveys the fed sheet in a predetermined direction, a conveying roller 118 which is rotatably disposed in the roller holder 119 in opposition to the conveying roller 117, a conveying spring 120 which urges the roller holder 119 so that the conveying roller 118 is pressed to the conveying roller 117 and the like.

Now, feeding operations of the sheet feeding apparatus will be described on the basis of FIGS. 9 to 11.

At a sheet feeding time and a stop time, the driving shaft 113 is rotated and stopped under rotating control with a controllable driving mechanism (not shown). When sheet feeding is to be started, the driving shaft 113 is rotated with a rotating drive force of the driving mechanism (not shown). This rotation is transmitted from the driving gear 112 to the following gear 123 by way of the gear train 124, whereby the sheet feeding roller 105 starts rotating. By urging means (not shown) and due to weights of the sheet feeding arm 114, the sheet feeding roller 105, the gear train 124 and the like, the sheet feeding arm 114 which is holding the sheet feeding roller 105 revolvably around the driving shaft 131 is subjected to a force in a direction to be rotated counterclockwise in the drawings. Due to this force, the sheet feeding roller 105 is in light pressure contact with a top surface of a sheet which is uppermost out of sheets mounted on the sheet feeding tray 121.

Accordingly, exerted to the sheet is a feeding force which is produced in a sheet feeding direction by a frictional force when the sheet feeding roller 105 starts rotating. At this time, the sheet is pressed to the separating slant surface plate 122 and subjected to a reaction force F. That is, a leading end portion of the sheet is subjected to the feeding force of the sheet feeding roller 105 while being pressed to the separating slant surface plate 122. As a result, the leading end portion of the sheet is curved. In a condition where the sheet is curved, the leading end of the sheet slides along the separating slant surface plate 122 toward the lower guide 115. When the sheets are to be sent out in an overlapped condition at this time, leading ends of the overlapped sheets are separated by the separating slant surface plate 122 and only one sheet is sent out. An advancing direction of the sheet is determined by the upper guide 116 and the lower guide 115, whereby the sheet enters a nip formed between the conveying roller 118 urged toward the carrying roller 117 by the carrying spring 120 and the conveying roller 117, and further conveyed by the conveying roller 117 in a direction indicated by an arrow A.

When a thick sheet having a high rigidity is to be fed, however, the conventional sheet feeding apparatus 101 may hardly curve the leading end portion of the thick sheet having the high rigidity with the separating slant surface plate 122, thereby allowing a sheet feeding pressure to be enhanced autonomously by rotations of a motor of the driving mechanism which rotates the driving shaft 113 and increasing a torque which is required for driving the sheet feeding roller 105.

Accordingly, the conventional sheet feeding apparatus uses a motor which has a large output torque so that even the thick sheet having the high rigidity can be fed by rotating the sheet feeding roller 105. However, the motor which has the large output torque is expensive and large. Accordingly, the conventional sheet feeding apparatus is expensive and may be large due to a large space required for installing the motor.

Furthermore, a small angle α is formed between the sheet feeding arm 114 and the sheet feeding tray 121 as shown in FIG. 10 when a large number of sheets are mounted on the sheet feeding trays 121. The sheet feeding roller 105 is subjected to the reaction force F of the sheet feeding force when rotated. This reaction force F is divided into a component of force N in a direction of the sheet feeding pressure and a component of force T in a direction along a longitudinal direction of the sheet feeding arm 114. However, the force N in the direction of the sheet feeding pressure is low since the angle α is small. Accordingly, a sheet feeding force remains weak since the sheet feeding pressure is not so high. When the thick sheet having the high rigidity is fed, the sheet feeding apparatus 101 is therefore incapable of advancing the sheet along the separating slant surface plate 122 and may cause improper sheet feeding. The angle α is an angle which is formed between a line L connecting a center of the driving shaft 113, that is, a center of the driving gear 112, to a center of the sheet feeding roller 105 and a top surface of the uppermost sheet.

When a small number of sheets are mounted on the sheet feeding tray 121, in contrast, a large angle α is formed between the sheet feeding arm 114 and the sheet feeding tray 121 as shown in FIG. 11. The sheet feeding roller 105 is subjected to a reaction force F of the sheet feeding force when rotated. This reaction force F is divided into a component of force N in the direction of the sheet feeding pressure and a component of force T in the direction along the longitudinal direction of the sheet feeding arm 114. However, the force N in the sheet feeding pressure is strong since the above described angle α is large. Accordingly, the sheet feeding pressure is high. The sheet feeding pressure is higher than required and a torque required for driving the sheet feeding roller 105 is also larger than required. As a result, the motor may be out of adjustment, thereby causing improper sheet feeding.

SUMMARY OF THE INVENTION

An object of the present invention is to provide a sheet feeding apparatus which is capable of enhancing performance for separating and feeding a thick sheet having high rigidity even when a sheet feeding arm and the sheet form a small angle for feeding the thick sheet having the high rigidity.

Another object of the present invention is to provide a sheet feeding apparatus which is capable of further enhancing performance for separating and feeding a thick sheet having high rigidity even when a sheet feeding arm and the sheet form a large angle for feeding the thick sheet having the high rigidity, A sheet feeding apparatus according to the present invention is characterized by comprising:

sheet supporting means for supporting a sheet;

a driving rotary member which is driven and rotated by a driving source;

a rocking member which is disposed on the above described driving rotary member so as to be capable of rocking;

a sheet feeding rotary member which is rotatably disposed on the above described rocking member and can be brought into contact with the sheet supported by the above described sheet support means;

a following rotary member which is coupled with the above described sheet feeding rotary member on the above described rocking member;

a winding and hanging member hung around the above described driving rotary member and the above described following rotary member;

a separating slant surface which is disposed on a side of leading ends of sheets fed out by the above described sheet feeding rotary member and functions to separate the sent sheets one by one; and rocking force generating means which is disposed on the above described rocking member, guides a tensed side of the above described winding and hanging member in a direction to separate this side from the above described sheets, and for generating a rocking force, on said rocking member, which brings the above described sheet feeding rotary member into pressure contact with the sheet by receiving a pressing force produced due to a tension of the tensed side.

DESCRIPTION OF THE PREFERRED EMBODIMENTS

Now, description will be made of embodiments of the present invention with reference to the accompanying drawings.

A printer will be described first as an example of image forming apparatus and a sheet feeding apparatus which is to be disposed in a main body of the printer will then be described. The sheet feeding apparatus is assembled not only in the main body of the printer but may be disposed and used in an apparatus which disposes sheets one by one.

(Printer)

Figure 1:
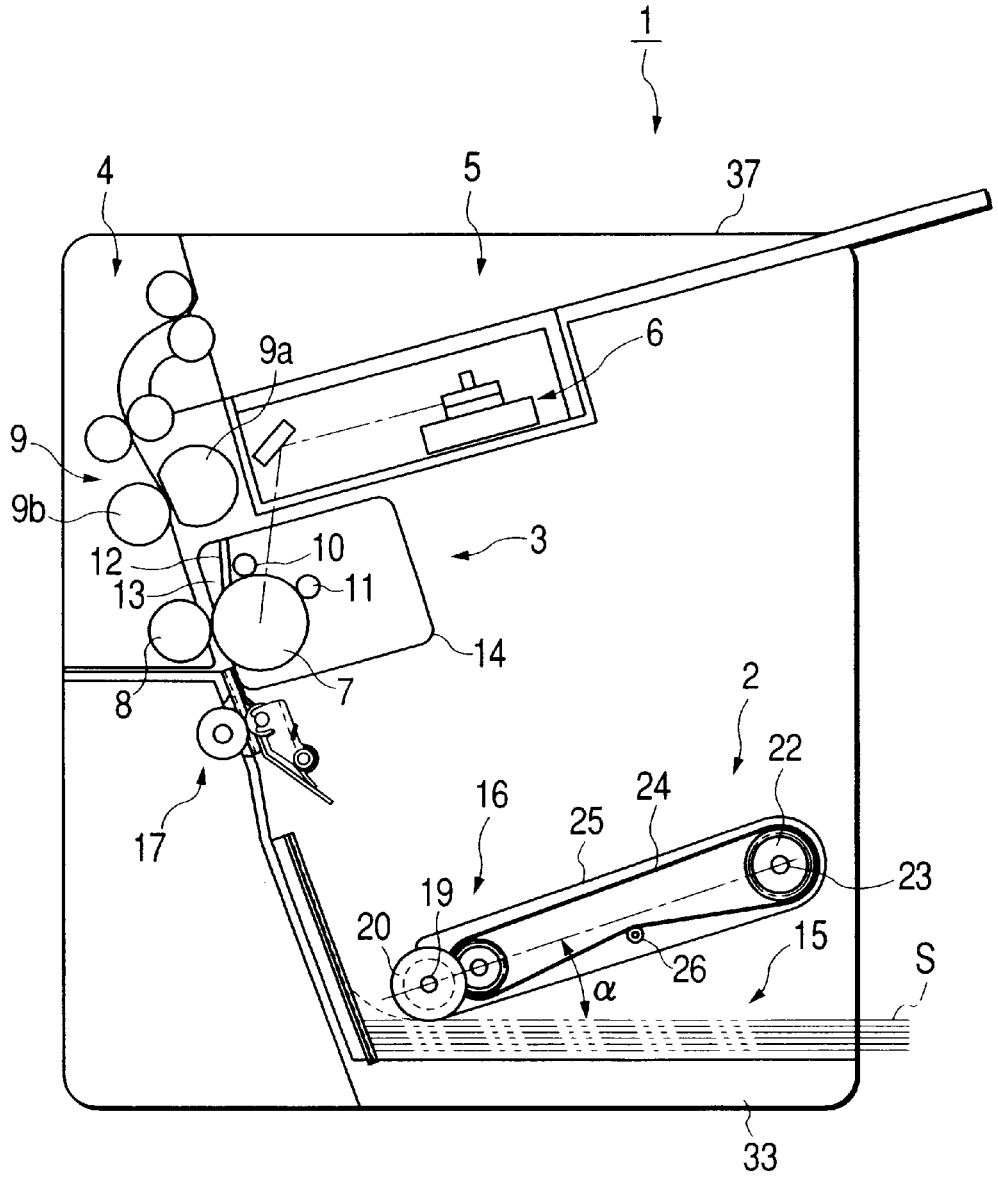
FIG. 1 is a schematic front sectional view of a printer (image forming apparatus) equipped with a sheet feeding apparatus according to an embodiment of the present invention.

In FIG. 1, a printer (image forming apparatus) 1 is equipped in a main body 37 with a sheet feeding apparatus 2 for containing a sheet S on which an image is to be formed, an image forming unit (image forming means) 3 for forming an image on the sheet sent out of the sheet feeding apparatus 2, a discharge unit 4 for discharging the sheet on which the image is formed by the image forming unit 3, a mounting unit 5 in which the discharged sheet is to be mounted.

The image forming unit 3 forms a latent image by projecting an optical image based on a target image information from an optical system 6 to a photosensitive drum by exposure means (a slit imaging projecting means, a laser scanning exposing means or the like (not shown) for an original image) and visualizes the latent image into a toner image with a developer (hereinafter referred to as a toner).

The sheet feeding apparatus 2 feeds the sheet in synchronization with formation of the toner image. The toner image which is formed on a photosensitive drum 7 is transferred to the fed sheet with a transferring roller 8. The toner image transferred to the sheet is fixed with a fixing apparatus 9 consisting of a fixing rotary member 9*a* having a built-in heater and a driving roller 9*b* which is in pressure contact with the fixing rotary member 9*a*. The sheet on which the toner image is fixed is discharged by the discharge unit 4 into the sheet mounting unit 5 and mounted.

In addition, the image forming unit 3 is equipped with the photosensitive drum 7 which has a photosensitive layer and rotates, a charging roller 10 which charges a surface of the photosensitive drum 7 uniformly by applying a voltage, a developing device 11 which develops the surface of the photosensitive drum 7 on which the latent image is formed by exposing the optical image from the optical system 6, a cleaner blade 12 which scrapes residual toner away from the surface of the photosensitive drum 7 after the toner image is transferred to the sheet with the transferring roller 8 and a process cartridge 14 which is configured as a unit consisting of a waste toner container 13 for collecting scraped toner and other members.

(Sheet Feeding Apparatus)

Figure 2:
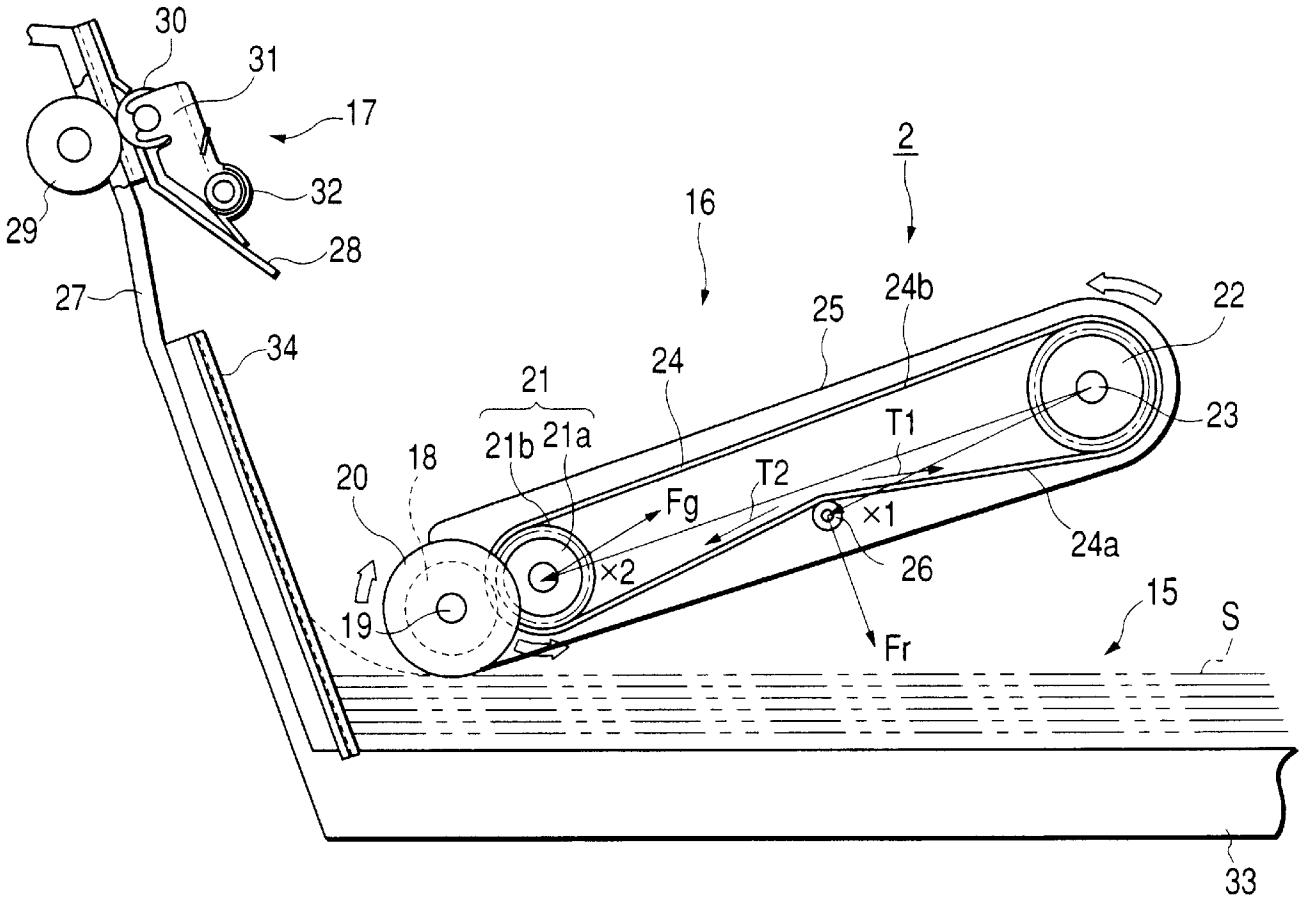
FIG. 2 is a schematic front sectional view of the sheet feeding apparatus shown in FIG. 1.

In FIG. 2, the sheet feeding apparatus 2 is composed of a sheet feeding tray unit 15 which is sheet support means for supporting sheets to be fed, a sheet feeding unit 16 which consecutively feeds the mounted sheets, a conveying unit 17 which conveys the fed sheets.

The sheet feeding tray unit 15 is composed of a sheet feeding tray 33 on which sheets S are to be mounted, a separating slant surface plate (separating slant surface) 34 which stops, disposes and separates the sheets while guiding the sheets obliquely at a sheet feeding time, and the like.

The sheet feeding unit 16 is composed of a sheet feeding arm (rocking member) 25 which is rotatably attached to a driving shaft 23, a driving gear (driving rotary member) 22 which is integrated with the driving shaft 23, a sheet feeding roller shaft 19 which is rotatably disposed at a rocking end of the sheet feeding arm 25, two sheet feeding rollers (sheet feeding rotary member) 20 which are fixed to the sheet feeding roller shaft 19 (the two rollers are overlapped with each other in FIG. 2), a sheet feeding roller driving gear 18 which is integrated with the sheet feeding roller shaft 19, a small diameter idler gear 21*a* which is rotatably disposed on the sheet feeding arm 25 and engaged with the sheet feeding roller driving gear 18, a large diameter idler gear 21*b* which is integrated with the small diameter idler gear 21*a* so as to have a shaft center coincident with that of the small diameter idler gear 21*a*, a belt (winding and hanging member) 24 which is hung over the large diameter idler gear 21*b* and driving gear 22, a tension pulley (tension member) 26 which guides a tensed side 24*a* of the belt 24 rotatably disposed on the sheet feeding arm 25 in a direction away from the sheet, and the like. In addition, the small diameter idler gear 21*a* and the large diameter idler gear 21*b* integrated therewith constitute a following rotary member.

The "tensed side" is a side of the belt 24 hung over the driving gear 22 and the large diameter idler gear 21*b* which is pulled by rotating the driving gear 22 (a belt portion between the driving gear 22 and the large diameter idler gear 21*b* which is indicated by reference numeral 24*a*). Furthermore, a side of the belt 24 which is opposite to the "tensed side" and sent out by the driving gear 22 (a belt portion between the driving gear 22 and the large diameter idler gear 21*b* which is indicated by reference numeral 24*b*) is referred to as a "loosened side".

The tension pulley 26 bears a pressing force Fr of the tensed side 24*a* which is generated due to a tension of the belt 24. By controlled driving means (not shown), the driving shaft 23 is controlled to as to be rotatingly driven at a sheet separating feeding time.

The conveying unit 17 is composed of a lower guide 27 which guides a bottom surface of the fed sheet, an upper guide 28 which is integrated with the lower guide 27 and guides a top surface of the fed sheet, a roller holder 31 which is rotatably supported by the upper guide 28, a conveying roller 29 which is disposed on the lower guide 27 and conveys the fed sheet in a predetermined direction, a conveying roller 30 which is rotatably disposed in the roller holder 31 so as to be opposed to the conveying roller 29, a conveying spring 32 which urges the roller holder 31 so that the conveying roller 30 is pressed to the conveying roller 29, and the like.

Then, description will be made of sheet feeding operations of the sheet feeding apparatus 2 on the basis of FIG. 2.

The driving shaft 23 is rotatingly driven by a controllable driving mechanism (not shown), thereby being rotated or stopped. To start feeding the sheets S, the driving shaft 23 is rotated under rotating control by the driving mechanism (not shown). This rotation is transmitted to the sheet feeding rollers 20 by way of the driving gear 22, the belt 24, the idler gears (following rotary member) 21, the sheet feeding roller driving gear 18 and the sheet feeding roller shaft 19. The sheet feeding rollers 20 starts rotating. Due to weights of the sheet feeding arm 25, the sheet feeding roller 20 and the like, the sheet feeding arm 25 which holds the sheet feeding roller 20 so as to be revolvable around the driving shaft 23 is subjected to a force in a direction to rotate counterclockwise in FIG. 2. Under this force, the sheet feeding roller 20 is in light pressure contact with an uppermost sheet out of the sheets mounted on the sheet feeding tray 33.

Accordingly, a feeding force is exerted, due to a frictional force, to the sheet in a sheet feeding direction when the sheet feeding roller 20 starts rotating. At this time, the sheet is pressed to the separating slant surface plate 34 and receives a reaction force F from the separating slant surface plate 34. A leading end portion of the sheet is subjected to the feeding force while being pressed to the separating slant surface plate 34. As a result, the leading end portion of the sheet is curved. In a condition where the leading end portion is curved, the leading end portion of the sheet slides along the separating slant surface plate 34 toward the lower guide 27.

Since the tension pulley 26 guides the tensed side 24*a* of the belt 24 in the direction away from the sheet S on the sheet feeding tray 33, a tension is applied to the tensed side 24*a* of the belt 24 when the driving shaft 23 is driven and the driving gear 22 rotates, whereby the tensed side 24*a* tends to be straight and applies a pressing force to the tension pulley 26. The tension pulley 26 is subjected to a force from the belt 24. Moreover, the tension pulley 26 is attached integrally with the sheet feeding arm 25. The pressing force of the tensed side 24*a* of the belt 24 is transmitted to the sheet feeding arm 25. Since this pressing force is in the counterclockwise direction in FIG. 2, a total force of the sheet feeding roller 20 which presses the top surface of the sheet is stronger than conventional. The feeding force of the sheet feeding roller 20 is strengthened accordingly.

When a thick sheet having a high rigidity is fed, a leading end of the sheet which is brought into contact with the separating slant surface plate 34 can hardly be curved, whereby the sheet feeding roller 20 can hardly rotate and a tension of the belt 24 is gradually enhanced. The force which the tension pulley 26 receives from the belt 24 is also strengthened gradually. As a result, a sufficient feeding force can be obtained and the sheet S can be separated and fed even when a small angle $\alpha$ is formed between the sheet feeding arm 25 and the sheet feeding tray 33.

That is, the sheet feeding roller 20 is subjected to the force which is not produced conventionally but generated by disposing the tension pulley 26 in addition to the force due to the weights of the sheet feeding roller 20, the sheet feeding arm 25 and the like as well as the force to rotate the sheet feeding arm 25 counterclockwise in FIG. 2. Accordingly, the sheet feeding apparatus according to the embodiment is configured to easily separate and feed thick sheets having high rigidities. In addition, the angle $\alpha$ is an angle which is formed between a line L connecting a center of the driving shaft 23 to a center of the sheet feeding roller shaft 19, that is, a line L connecting a center of the driving gear 22 to a center of the sheet feeding roller 20 and a top surface of the uppermost sheet as shown in FIG. 1.

Now, description will be made here in detail of enhancement of the pressing force of the sheet feeding roller 20 for the sheet S which is obtained by disposing the tension pulley 26.

When the driving gear 22 rotates in a direction indicated by an arrow (counterclockwise) in FIG. 2, a tension T1 is applied to the tensed side 24*a* of the belt 24. Slide resistance is produced between the belt 24 and the tension pulley 26. Accordingly, a tension of the belt 24 between the tension pulley 26 and the idler gear 21 is T2 (T2<T1). A resultant force of T1 and T2 is a force Fr which presses the tension pulley 26 by way of the belt 24. The idler gear 21 receives forces from a portion around which the belt 24 is wound. Since forces which are given from the belt 24 to the idler gear 21 are gradually weakened from the tensed side, a resultant force of the forces which are given from the belt 24 to the idler gear 21 is Fg.

The sheet feeding arm 25 is disposed rotatably around the driving shaft 23. As seen from a side of the sheet feeding roller 20, the sheet feeding arm 25 is subjected to the force Fr from the tension pulley 26 and the force Fg from the idler gear 21. When positions of the tension pulley 26 and the idler gear 21 relative to the driving shaft 23 are denoted by X1 and X2 respectively, a rotation moment of the sheet feeding arm 25 around the driving shaft 23 is a moment (X1×Fr)+moment (X2×Fg). Since the moment (X2×Fg) is small as judged from FIG. 2, counterclockwise rotation moments of the sheet feeding arm 25 are not balanced around the driving shaft 23, thereby acting as a force which brings the sheet feeding roller 20 into pressure contact with the sheet.

The sheet feeding apparatus 2 has merits which are described below.

Since the tension pulley 26 which is subjected to the pressing force of the tensed side 24*a* of the belt 24 produces a force to rotate the sheet feeding arm 25, the sheet feeding force is increased gradually even when the angle $\alpha$ is small between the sheet feeding arm 25 and the sheet S, so that the sheet feeding apparatus 2 is capable of separating and feeding a thick sheet having a high rigidity without fail and enhancing sheet feeding performance.

Since a rotating torque of the driving shaft 23 is transmitted by the belt 24, the sheet feeding apparatus 2 is composed of a smaller number of parts and is less expensive than a sheet feeding apparatus having the conventional configuration in which a rotating torque is transmitted by way of gears.

Though the idler gear 21 is engaged with the sheet feeding driving gear 18 in the embodiment, similar effects can be obtained when the idler gear 21 is engaged with the driving gear 22. Furthermore, similar effects can be obtained when a plurality of idler gears are used.

Figure 3:
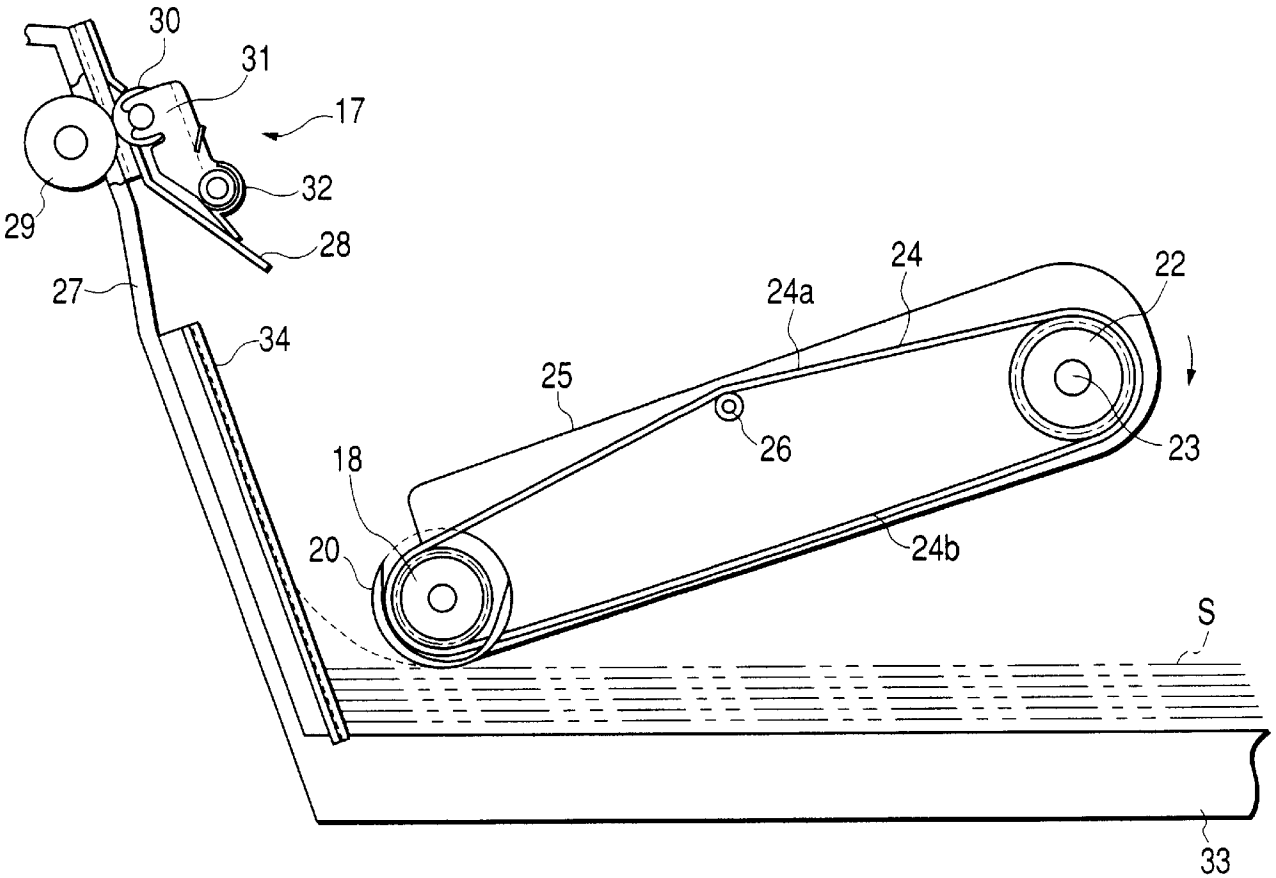
FIG. 3 is a schematic front sectional view of a sheet feeding apparatus in which a tension pulley (rocking force generating means) is disposed at a location different from that in FIG. 2.
Figure 4:
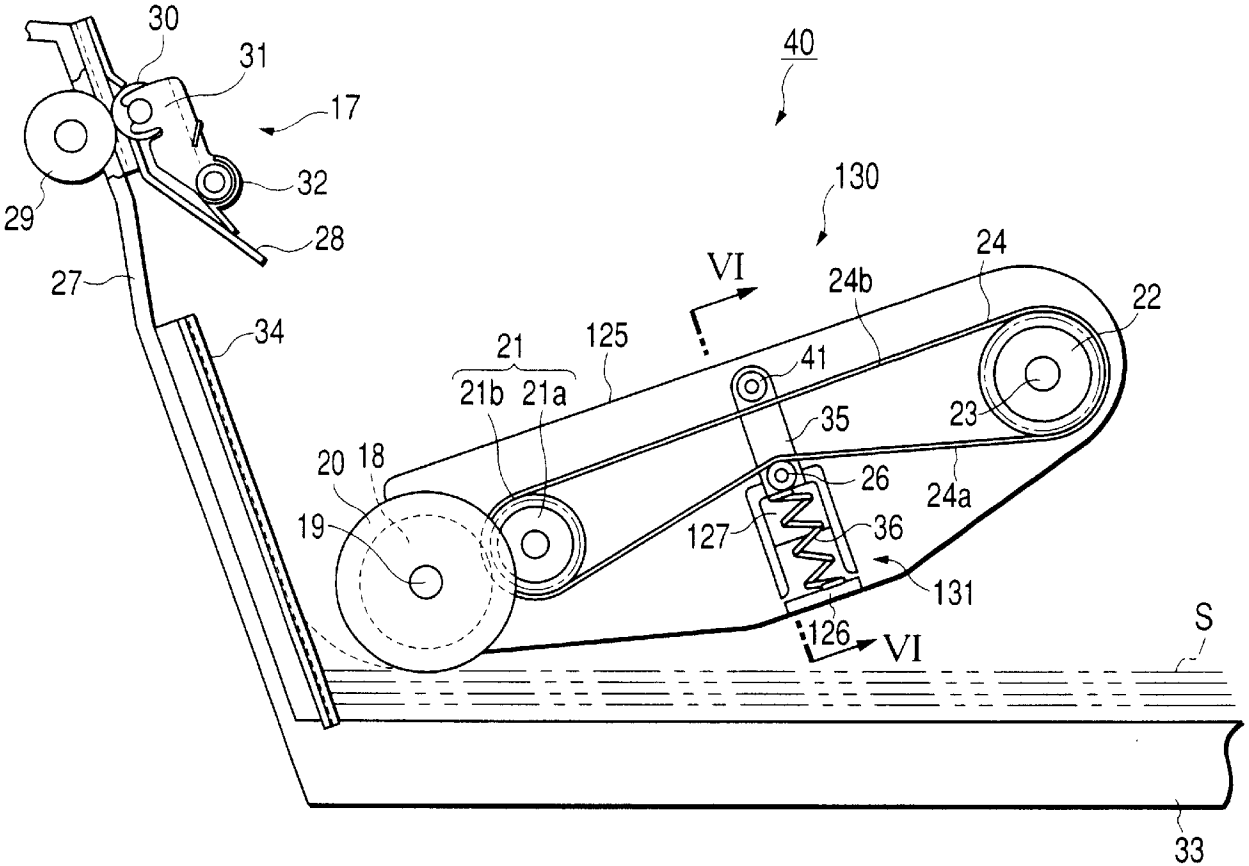
FIG. 4 is a schematic front sectional view of a sheet feeding apparatus according to another embodiment.
Figure 5:
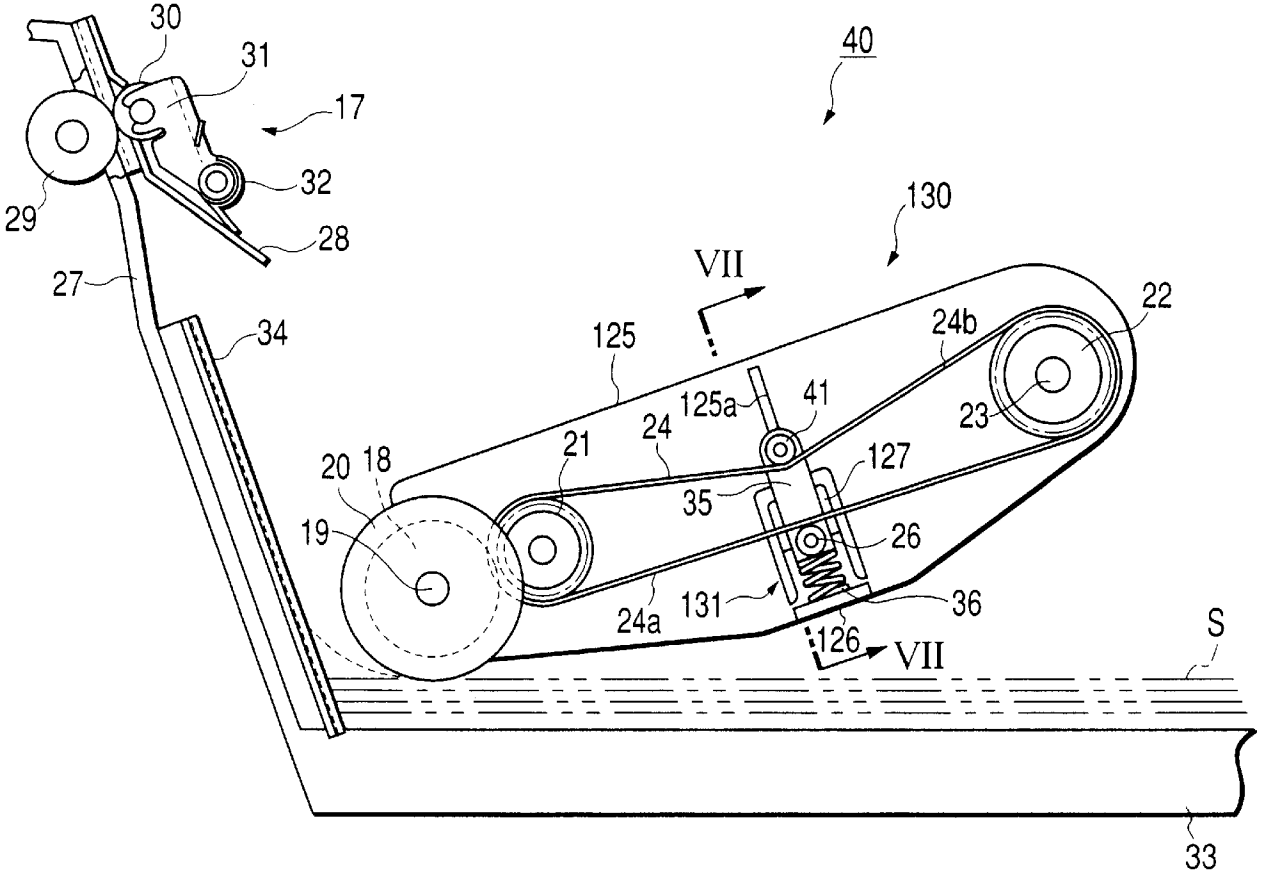
FIG. 5 is a diagram descriptive of operations of the sheet feeding apparatus shown in FIG. 4.
Figure 6:
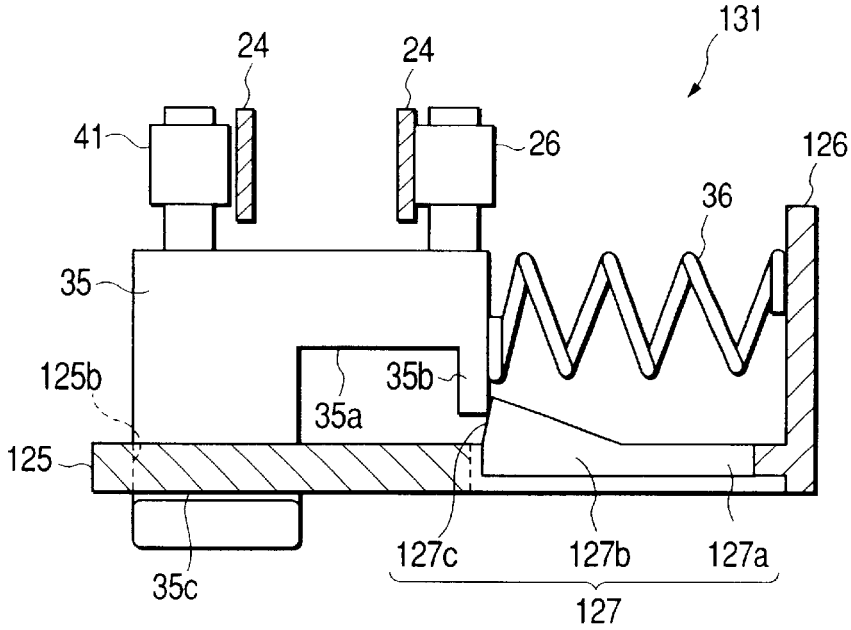
FIG. 6 is a sectional view taken along a VI—VI line in FIG. 4.

Though the belt 24 is hung between the idler gear 21 and the driving gear 22 in the embodiment, the belt 24 may be hung between the driving gear 22 and the sheet feeding roller driving gear 18 with the idler gear 21 omitted as shown in FIG. 3. In this case, it is necessary to rotate the driving gear 23 in a reverse direction and the tensed side 24*a* of the belt 24 is located upper. Even in this case, it is necessary to guide the tensed side 24*a* of the belt 24 with the tension pulley 26 in a direction away from the sheet S on the sheet feeding tray 33. Such an arrangement allows a configuration simpler.

(Sheet Feeding Apparatus According to Another Embodiments)

A sheet feeding apparatus 40 according to another embodiment which is shown in FIGS. 4 through 8 is configured to prevent abrupt strengthening of a sheet feeding force of a sheet feeding roller 20 which is produced by a tension pulley 26. Accordingly, the sheet feeding apparatus according to this embodiment is different from the sheet feeding apparatus 2 according to the preceding embodiment in a configuration of a portion related to the tension pulley 26. Description will be made mainly of this portion while denoting identical portions by the same reference numerals and partially omitting description of the identical portions.

A sheet feeding unit 130 of the sheet feeding apparatus 40 is composed of a sheet feeding arm (rocking member) 125 which is rotatably attached to a driving shaft 23, a driving gear (driving rotary member) 22 which is integrated with the driving shaft 23, a sheet feeding roller shaft 19 which is rotatably disposed at a rocking end of the sheet feeding arm 125, two sheet feeding rollers (a sheet feeding rotary member) 20 (the two rollers overlapped with each other in FIG. 2) which are fixed to the sheet feeding roller shaft 19, a sheet feeding roller driving gear 18 which is integrated with the sheet feeding roller shaft 19, a small diameter idler gear 21*a* which is rotatably disposed on the sheet feeding arm 125 and engaged with the sheet feeding roller driving gear 18, a large diameter idler gear 21*b* which is integrated with the small diameter idler gear 21*a* so as to have a shaft center coincident with that of the smaller diameter idler gear 21*a*, a belt (winding and hanging member) 24 which is hung over the large diameter idler gear 21*b* and the driving gear 22, a tension pulley holder 35 which is disposed on the sheet feeding arm 125 so as to be capable of being brought close and apart to and from the belt 24, an urging spring (urging member) 36 which is disposed on the sheet feeding arm 125 for urging the tension pulley holder 35 toward the belt 24, a tension pulley 26 which is disposed on the tension pulley holder 35 for guiding a tensed side 24*a* of the belt 24 in a direction away from a sheet, an auxiliary tension pulley (auxiliary tension member) 41 which is rotatably disposed on the tension pulley holder 35 so as to be capable of being brought into contact with a loosened side 24*b* of the belt 24, and the like.

A notch portion 35*a*, a protruding portion 35*b* and a rail portion 35*c* are formed on the tension pulley holder 35. The rail portion 35*c* is fitted in rectangular elongated hole 125*b* which is formed in the sheet feeding arm 125 in a direction intersecting with the belt 24. The tension pulley holder 35 is configured so that it can be brought close and far to and from the belt 24 with the rail portion 35*c* and the rectangular elongated hole 125*b*, and a moving distance is limited. The urging spring 36 is disposed in a compressed condition between a erected piece 126 protruding from the sheet feeding arm 125 and the tension pulley holder 35. The sheet feeding arm 125 is equipped with a snap fitted member (regulating member) 127 which has a shape of a tongue. A root portion 127*a* of the snap fitted member 127 is configured thinner than a tip portion 127*b* so that the snap fitted member 127 has elasticity. The tip portion 127*b* is configured in a shape of a mountain. A tip end surface 127*c* of the tip portion 127*b* is configured as a slant surface inclined toward the root portion 127*a*. The tip end surface 127*c* is configured to regulate the protruding portion 35*b* of the tension pulley holder 35.

In addition, the tension pulley holder 35, the urging spring 36, the tension pulley 26, the auxiliary pulley 41, the rectangular elongated hole 125*b*, the erected piece 126 and the like constitute a rocking force generating mechanism (rocking force generating means) 131.

Now, description will be made of a sheet feeding operation of the sheet feeding apparatus 40.

When the sheet feeding apparatus 40 starts the sheet feeding operation, the driving shaft 23 is driven and rotated by a driving mechanism (not shown). This rotation is transmitted to the sheet feeding roller 20 by way of the driving gear 22, the belt 24, the idler gear (following rotary member) 21, the sheet feeding roller driving gear 18 and the sheet feeding roller shaft 19. The sheet feeding roller 20 starts rotating. The sheet feeding arm 125 which holds the sheet feeding roller 20 so as to be revolvable around the driving shaft 23 is subjected to a force in a direction to be rotated counterclockwise in FIGS. 4, 5 due to weights of the sheet feeding arm 25, the sheet feeding roller 20, the rocking force generating mechanism 131 and the like. Under this force, the sheet feeding roller 20 lightly against a top surface of the uppermost sheet of the sheets mounted on the sheet feeding tray 33.

Accordingly, exerted to the sheet is a feeding force which is generated by a frictional force when the sheet feeding roller 20 starts rotating. At this time, the sheet is subjected to a reaction force while being pressed to a separating slant surface plate 34. That is, a leading end portion of the sheet is subjected to a feeding force of the sheet feeding roller 20 while being pressed to the separating plate 34. As a result, the leading end portion of the sheet is curved. In a condition where the sheet is curved, the leading end portion of the sheet slides along the separating slant surface plate 34 toward a lower guide 27.

Furthermore, the tension pulley holder 35 is urged by the urging spring 36 and the tension pulley 26 applies a tension to the tensed side 24*a* of the belt 24. When the driving shaft 23 is driven and the driving gear 22 rotates, the tension is applied to the belt 24 and the tensed side 24*a* tends to be straight, thereby applying a pressing force to the tension pulley 26. The tension pulley 26 is subjected to a force from the belt 24. Since the tension pulley 26 is attached to the tension pulley holder 35, the tension pulley holder 35 moves in a direction to hang the belt 24 (direction toward the sheet S) against the urging spring 36. The protruding portion 35*b* of the tension pulley holder 35 strikes against the tip end surface 127*c* of the snap fitted member 127 of the sheet feeding arm 125 and the tension pulley holder 35 stops moving (see FIG. 6). In this while, a force is applied also to the sheet feeding arm 125 from the belt 24. Since this force is directed counterclockwise in FIGS. 4 and 5, a total force which brings the sheet feeding roller 20 into pressure contact with the top surface of the sheet is stronger than conventional. A feeding force of the sheet feeding roller 20 is also strengthened. As a result, a force sufficient for separating and feeding the sheet is obtained even when a small angle $\alpha$ is formed between the sheet feeding arm 125 and a sheet feeding tray 33, thereby enhancing sheet separating and feeding performance of the sheet feeding apparatus 40.

Figure 7:
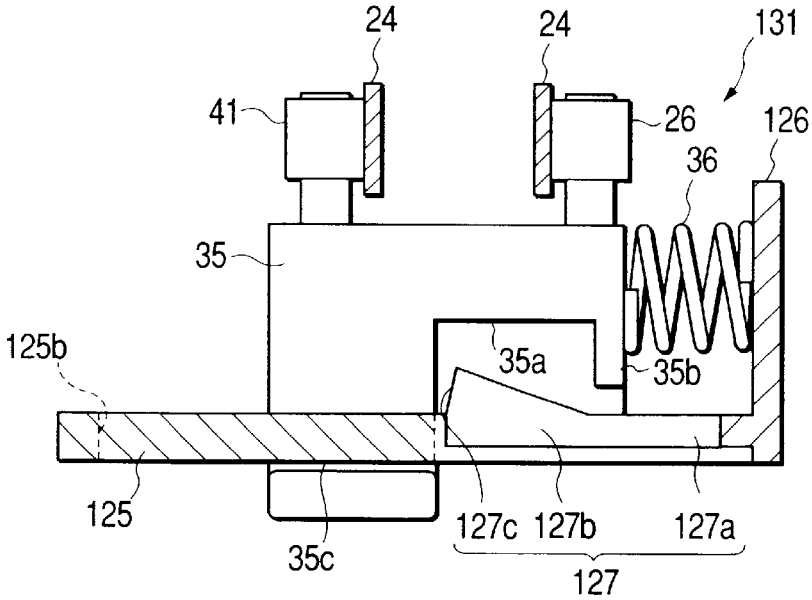
FIG. 7 is a sectional view taken along a VII—VII line in FIG. 5.
Figure 8:
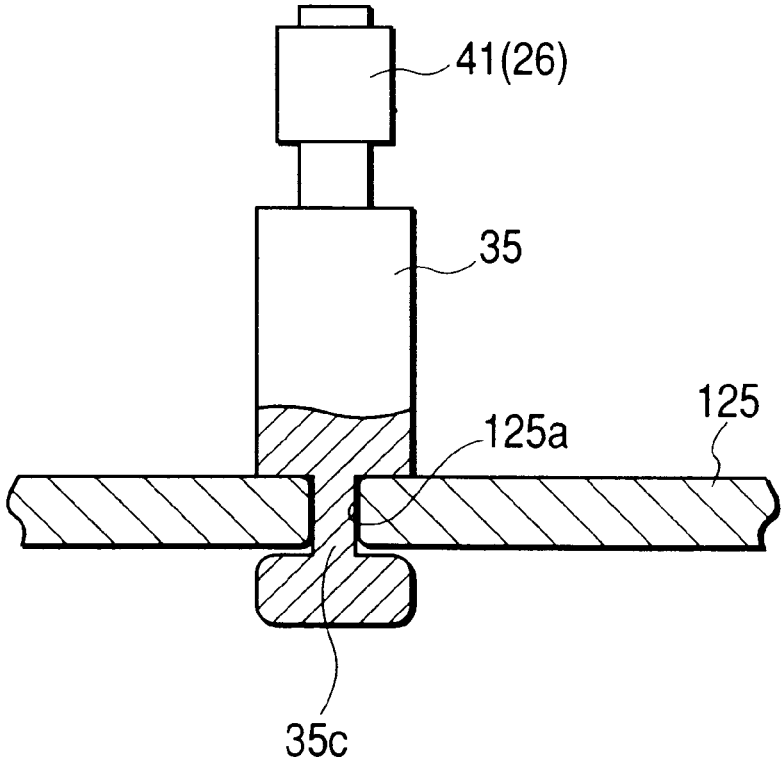
FIG. 8 is a partial sectional view of a tension pulley holder shown in FIG. 6 as seen from a left side.
Figure 9:
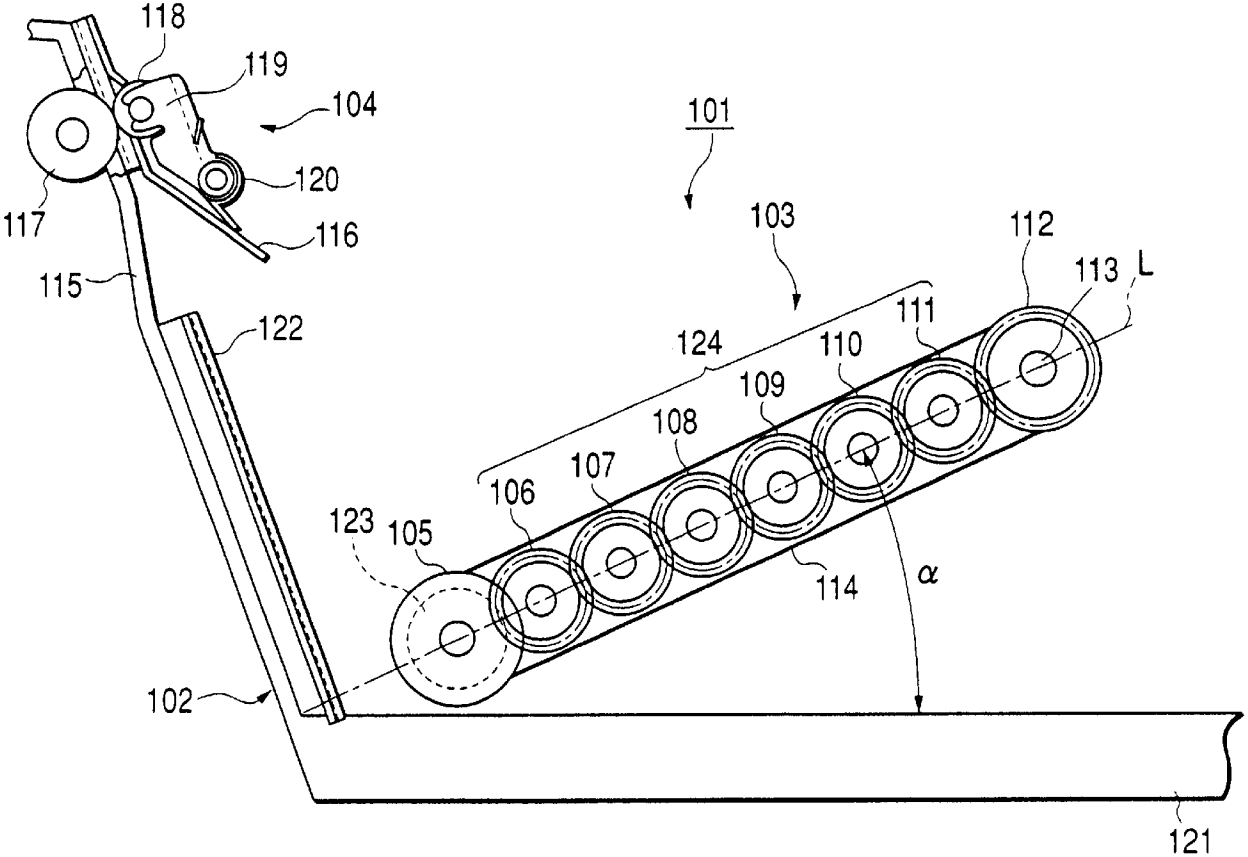
FIG. 9 PRIOR ART
FIG. 9 is a schematic front sectional view of a conventional sheet feeding apparatus.
Figure 10:
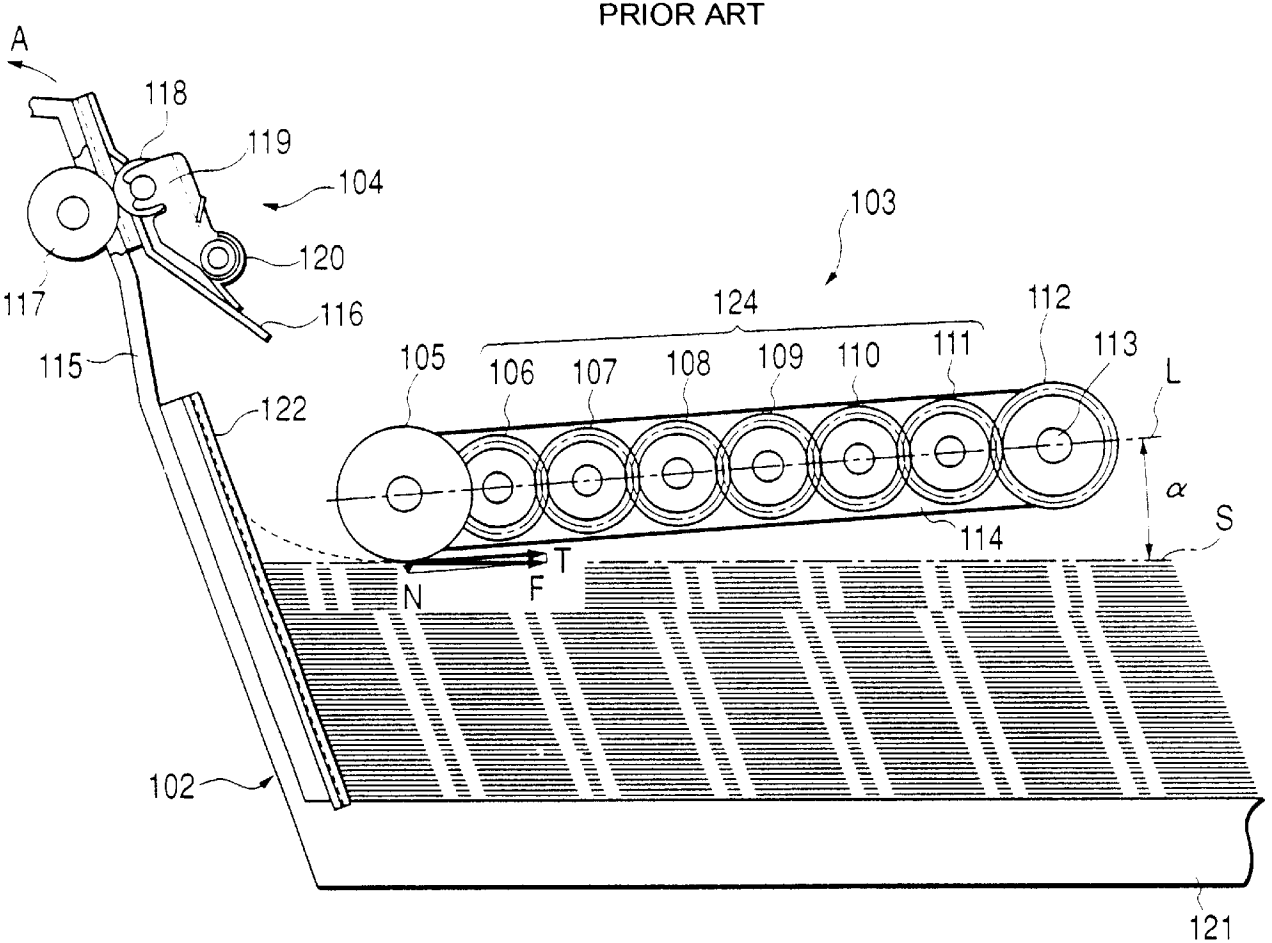
FIG. 10 PRIOR ART
FIG. 10 is a schematic front sectional view of the conventional sheet feeding apparatus in a condition where a large number of sheets are mounted.
Figure 11:
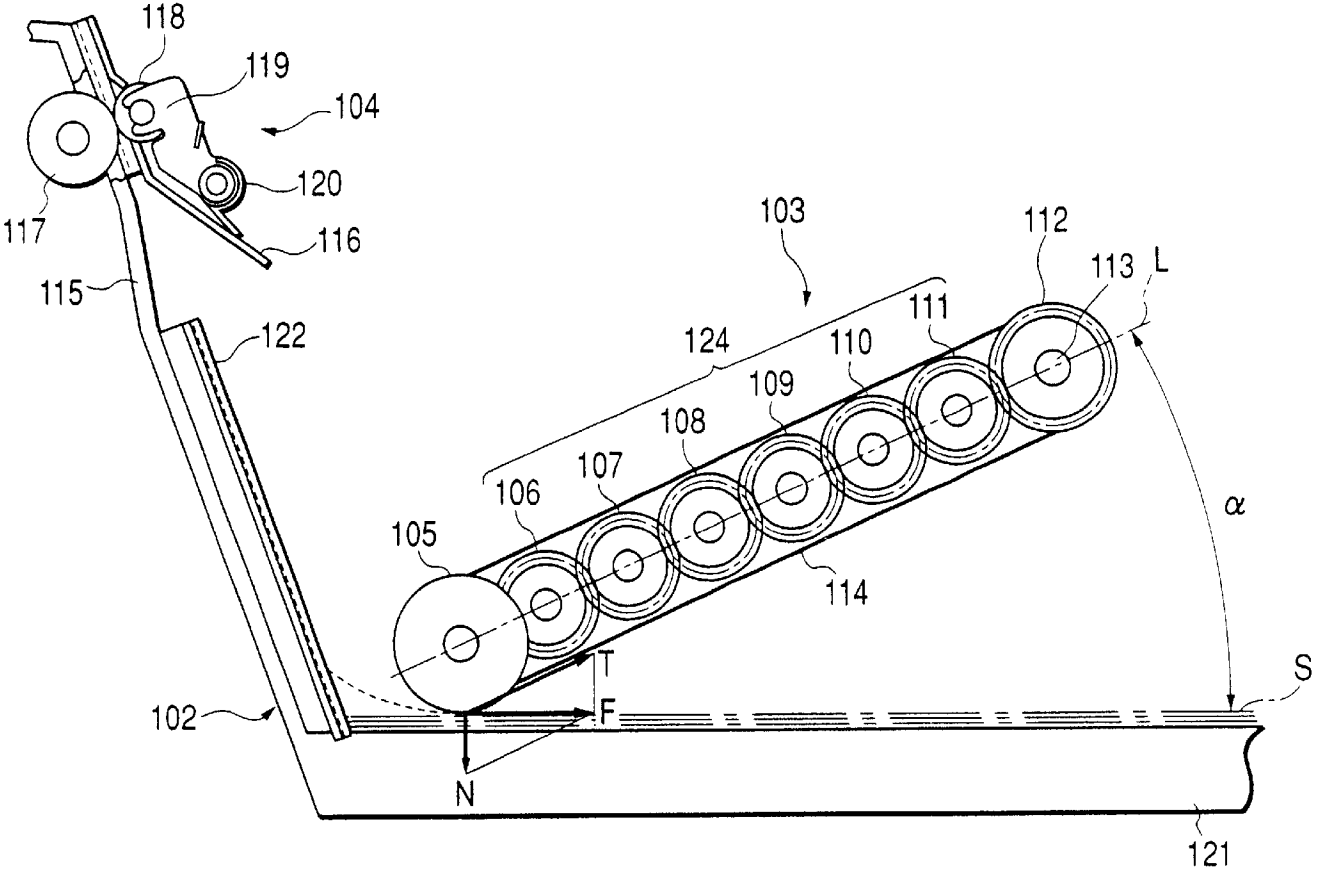
FIG. 11 PRIOR ART
FIG. 11 is a schematic front sectional view of the conventional sheet feeding apparatus in a condition where a small number of sheets are mounted.

When a thick sheet having a high rigidity is fed, a leading end of the sheet which is in contact with the separating slant surface plate 34 can hardly be curved, whereby the sheet feeding roller 20 hardly rotates and a tension of the belt 24 is gradually enhanced. A force which is applied to the tension pulley 26 from the belt 24, that is, a force which is applied to the tension pulley holder 35 from the belt 24 is gradually strengthened. When the force exceeds a certain predetermined force, the snap fitted member is elastically deformed as shown in FIG. 7, whereby the protruding portion 35*b* of the tension pulley holder 35 is released and approaches the erected piece 126. The tensed side 24*a* of the belt 24 enters a condition where it is straight. The tip portion 127*b* of the snap fitted member 127 is accepted into the notch portion 35*a* of the tension pulley holder.

Since a spacing between the tension pulley 26 and the auxiliary tension pulley 41 is set narrower than a spacing between the tensed side 24*a* and the loosened side 24*b* of the belt 24, on the other hand, the auxiliary tension pulley 41 which is disposed on the tension pulley holder 35 applies a tension to the loosened side 24*b* of the belt 24.

When the snap fitted member 127 of the sheet feeding arm 125 is deformed and the protruding portion 35*b* of the tension pulley holder 35 is released, tensed side 24*a* of the belt 24 which is subjected to the tension presses the tension pulley holder 35 with a weak force. Since a large angle $\alpha$ is formed between the sheet feeding arm 125 and the sheet feeding tray 33, an enhancing rate is lowered for a sheet feeding pressure which has so far been enhanced abruptly. Accordingly, a sheet feeding force is not enhanced stronger than required for feeding the thick sheet having the high rigidity and improper feeding is not caused even when the angle $\alpha$ is large between the sheet feeding arm 125 and the sheet feeding tray 33.

The sheet feeding apparatus 40 according to the other embodiment has merits which are described below.

Since the sheet feeding apparatus 40 is configured to generate a rotating force of the sheet feeding arm 125 at an initial stage with the tension pulley 26 which is subjected to the pressing force of the tensed side 24*a* of the belt 24, the sheet feeding apparatus 40 is capable of separating and feeding the thick sheet having the high rigidity by gradually strengthening the sheet feeding force even when the small angle $\alpha$ is formed between the sheet feeding arm 125 and the sheet feeding tray 33, thereby enhancing sheet feeding performance.

Since the sheet feeding apparatus 40 is configured to support the tensed side 24*a* of the belt 24 with the tension pulley 26 and save this tension pulley when it is subjected to a force equal to or stronger than the predetermined force, the sheet feeding apparatus 40 is capable of preventing a sheet feeding force required for separating and feeding the thick sheet having the high rigidity from being stronger than required when the angle $\alpha$ is large between the sheet feeding arm 125 and the sheet S, thereby preventing improper feeding of the thick sheet having the high rigidity.

Since the sheet feeding apparatus 40 is configured to use the belt 24 for transmission of a rotating torque of the driving shaft 23, the sheet feeding apparatus 40 uses a smaller number of parts and less expensive than the a sheet feeding apparatus which is configured to transmit a rotating torque by way of gears.

The sheet feeding apparatus 40 according to the embodiment gradually strengthening the feeding force for feeding the thick sheet having the high rigidity and prevents the feeding force from being stronger than required, thereby being capable of further enhancing separating and feeding performance for the thick sheet having the high rigidity regardless of the angle $\alpha$ between the sheet feeding arm 125 and the sheet feeding tray 33.

In addition, the tension pulley 26 may not be one but a plurality. Furthermore, a chain may be used in place of the belt 24 which is toothed for hanging around the gears 22 and 21*b* or the gears 22 and 18. Furthermore, pulleys may be used in place of the gears and a belt which is not toothed may be used in place of the toothed belt. Furthermore, pulley may be used in place of the gears and a wire may be used in place of the belt.

What is claimed is:

1. A sheet feeding apparatus comprising:

sheet supporting means for supporting a sheet;

a driving rotary member driven and rotated by a driving source;

a rocking member rockable with respect to said driving rotary member;

a sheet feeding rotary member rotatably disposed on said rocking member and contactable with the sheet supported by said sheet supporting means;

a following rotary member coupled with said sheet feeding rotary member on said rocking member;

a winding and hanging member hung around said driving rotary member and said following rotary member;

a separating slant surface disposed on a side of leading ends of sheets fed out by said sheet feeding rotary member for separating the sheets one by one; and rocking force generating means disposed on said rocking member for guiding a tensed side of said winding and hanging member on a side of said rocking force generating means opposite said sheet supporting means, wherein said rocking force generating means generates a rocking force which urges said rocking member toward said sheet supporting means by receiving a pressing force produced due to a tension of the tensed side so that said sheet feeding rotary member is urged toward said sheet supporting means, wherein a fulcrum of said rocking member is disposed on an upstream side of said sheet feeding rotary member.

2. A sheet feeding apparatus according to claim 1, wherein said rocking force generating means includes a tension member which receives the tensed side of said winding and hanging member in a tensed condition.

3. A sheet feeding apparatus according to claim 1, wherein said rocking force generating means includes a tension member which receives the tensed side of said winding and hanging member in a tensed condition, a holder which supports said tension member so as to be movable in accordance with a change of a tensile force of said winding and hanging member and an urging member which urges said holder so that said tension member presses the tensed side of said winding and hanging member.

4. A sheet feeding apparatus according to claim 3, wherein said rocking force generating means includes a regulating member which regulates a movement of said tension member until a pressing force generated due to a tension of said tensed side becomes not less than a predetermined pressing force when said tension member is pushed back by a pressing force generated due to a tension of said tensed side against said urging member.

5. A sheet feeding apparatus according to claim 4, wherein said regulating member is elastically deformed, thereby releasing said tension member from regulation when the pressing force generated due to the tension of said tensed side exceeds the predetermined force.

6. A sheet feeding apparatus according to claim 3, wherein disposed on said holder is an auxiliary tension member which is engaged with a loosened side of said winding and hanging member and presses said loosened side as said tension member moves.

7. A sheet feeding apparatus according to claim 6, wherein a spacing between said tension member and said auxiliary tension member is set narrower than a space between said tensed side and said loosened side of said winding and hanging member.

8. A sheet feeding apparatus according to claim 1, wherein said sheet feeding rotary member and said following rotary member are rotated and interlocked by a gear.

9. A sheet feeding apparatus according to claim 1, wherein said sheet feeding rotary member and said following rotary member are coaxially integrated.

10. An image forming apparatus comprising:

sheet supporting means for supporting a sheet;

a driving rotary member driven and rotated by a driving source;

a rocking member rockable with respect to said driving rotary member;

a sheet feeding rotary member rotatably disposed on said rocking member and contactable with the sheet supported by said sheet supporting means;

a following rotary member coupled with said sheet feeding rotary member on said rocking member;

a winding and hanging member hung around said driving rotary member and said following rotary member;

a separating slant surface disposed on a side of leading ends of the sheets fed out by said sheet feeding rotary member for separating the sheets one by one; and rocking force generating means disposed on said rocking member for guiding a tensed side of said winding and hanging member on a side of said rocking force generating means opposite said sheet supporting means, wherein said rocking force generating means generates a rocking force which urges said rocking member toward said sheet supporting means by receiving a pressing force produced due to a tension of the tensed side so that said sheet feeding rotary member is urged toward said sheet supporting means; and image forming means for forming images on the sheets separated and fed by said separating slant surface, wherein a fulcrum of said rocking member is disposed on an upstream side of said sheet feeding rotary member.

11. A sheet feeding apparatus comprising:

sheet supporting means for supporting a sheet;

a driving rotary member driven and rotated by a driving source;

a rocking member rockable with respect to said driving rotary member;

a sheet feeding rotary member rotatably disposed on said rocking member and contactable with the sheet supported by said sheet supporting means;

a following rotary member coupled with said sheet feeding rotary member on said rocking member;

a winding and hanging member hung around said driving rotary member and said following rotary member; and rocking force generating means disposed on said rocking member for guiding said winding and hanging member on a side of said rocking force generating means opposite said sheet supporting means, wherein said rocking force generating means generates a rocking force which urges said rocking member toward said sheet supporting means by receiving a pressing force produced due to a tension of said winding and hanging member so that said sheet feeding rotary member is urged toward said sheet supporting means, wherein a fulcrum of said rocking member is disposed on an upstream side of said sheet feeding rotary member.

* * * * *

UNITED STATES PATENT AND TRADEMARK OFFICE

CERTIFICATE OF CORRECTION

PATENT NO. : 6,769,680 B2
DATED : August 3, 2004
INVENTOR(S) : Ryuichi Kojima et al.

It is certified that error appears in the above-identified patent and that said Letters Patent is hereby corrected as shown below:

Title page,
Item [56], References Cited, FOREIGN PATENT DOCUMENTS,
"JP 55052832 A 4/1980" should read -- JP 55-52832 A 4/1980 --;
"JP 62175367 A 8/1987" should read -- JP 62-175367 A 8/1987 --; and
"JP 5278880 A 10/1993" should read -- JP 5-278880 A 10/1993 --.

Column 6,
Line 14, "to as to" should read -- so as to --.
Line 38, "rollers" should read -- roller --.

Column 8,
Line 26, "Embodiments)" should read -- Embodiment) --.

Column 9,
Line 10, "a erected" should read -- an erected --.

Column 11,
Line 9, "strengthening" should read -- strengthens --.
Line 21, "pulley" should read -- pulleys --.

Signed and Sealed this

Twelfth Day of October, 2004

JON W. DUDAS
*Director of the United States Patent and Trademark Office*